United States Patent [19]

Ferland et al.

[11] Patent Number: 5,061,370

[45] Date of Patent: Oct. 29, 1991

[54] SCREENING DEVICE FOR SLURRIES WITH IMPROVED ROTOR AND HUB DESIGN

[75] Inventors: Carl G. Ferland, Port Robinson; Henry J. Peters, St. Catharines, both of Canada

[73] Assignee: Quebec and Ontario Paper Company Ltd., Thorold, Canada

[21] Appl. No.: 496,261

[22] Filed: Mar. 20, 1990

[51] Int. Cl.[5] ..... B04B 5/12

[52] U.S. Cl. ..... 210/194; 162/4; 162/380; 209/273; 210/358; 210/414; 210/415; 241/46.17; 416/179; 416/237

[58] Field of Search ..... 162/4, 55, 380, 251; 209/273, 306; 210/380.3, 383, 414, 415, 403, 194, 358; 416/237, 179, 181; 494/36; 241/46.11, 46.17

[56] References Cited

U.S. PATENT DOCUMENTS

| | | | |
|---|---|---|---|
| 946,281 | 1/1910 | Smith | 416/237 |
| 1,134,304 | 4/1915 | Westbye | 209/273 |
| 2,621,793 | 12/1952 | Gerecht | 209/279 |
| 2,682,811 | 7/1954 | Infanger | 210/415 |
| 3,446,663 | 5/1969 | Castiello et al. | 210/415 |
| 3,497,060 | 2/1970 | Tra et al. | 210/414 |
| 3,889,885 | 6/1975 | Couture | 241/46.17 |
| 3,912,622 | 10/1975 | Bolton et al. | 209/306 |
| 4,109,872 | 8/1978 | Couture | 241/46.17 |
| 4,222,863 | 9/1980 | Young | 210/414 |
| 4,234,417 | 11/1980 | Gauld et al. | 210/415 |
| 4,238,324 | 12/1980 | Musselmann et al. | 209/273 |
| 4,287,055 | 9/1981 | Holz | 209/273 |
| 4,316,768 | 2/1982 | Goddard | 156/513 |
| 4,396,502 | 8/1983 | Justus | 209/273 |
| 4,697,982 | 11/1987 | Hopper | 209/273 |

FOREIGN PATENT DOCUMENTS

| | | | |
|---|---|---|---|
| 1171418 | 1/1959 | France | 416/237 |
| 1-213490 | 8/1989 | Japan | 241/46.17 |

*Primary Examiner*—Robert A. Dawson
*Assistant Examiner*—Joseph Drodge
*Attorney, Agent, or Firm*—Sim & McBurney

[57] ABSTRACT

Aqueous slurries of particulate materials, particularly wood pulp slurries produced during the recycling of newsprint and other paper products, are processed to recover an accepts fraction in a rotary filter having a hollow cylindrical rotor. The rotor is modified to prevent plugging by outwardly tapering the inner wall of the rotor from its upstream towards a downstream end, so as to cause heavy particles tending to accumulate on the wall to flow towards the downstream end and not accumulate. At the downstream end, vane-like hub supports are provided angularly offset from the axis of the rotor to impart motion to the slurry passing through the rotor to assist in circulation of the slurry within the filter housing.

9 Claims, 4 Drawing Sheets

SCREENING DEVICE FOR SLURRIES WITH IMPROVED ROTOR AND HUB DESIGN

FIELD OF INVENTION

The present invention relates to a screening device for the separation of solid particulate material usually in the form of wood fibres, particularly in the recycling of newsprint.

BACKGROUND TO THE INVENTION

A significant proportion of newsprint is recycled. In a typical operation, the newsprint is pulped, screened to remove large containments, deinked, further screened to remove smaller containments, dewatered and then forwarded to stock make-up for a paper making machine.

During the screening operations, a variety of contaminants associated with the incoming newsprint are removed with generally larger and heavier contaminants being removed before smaller and lighter contaminants. For smooth and continuous operation of the recycling plant, it is essential that the screening operation further function efficiently. Unfortunately certain filters used in such operation are prone to plugging and screen wear.

Particulars problems have been encountered with a form of rotary screen filter which comprises a housing with which is fed the pulp for decontamination, a horizontal rotor which deems to circulate the pulp within the housing, and a circular accepts screen basket through which the decontaminated pulp is removed. The rejects fraction is slurried within the housing and is dumped from time to time.

The rotor is hollow and has external foils which assist both in circulation of the slurry within the housing and in expelling the accepts fraction through the screen basket. In proper operation, the screen feed is removed from the inlet by the foils past the screen basket through which the accepts fraction passes with the remainder moving past the rotor. The slurry is recirculated through the rotor interior and back for another pass. Such internal recycle is essential to ensure a proper separation of an accepts fraction from the rejects fraction.

However, heavy materials tend to build up on the interior surface of the rotor until eventually recirculation stops and the screen plugs. Attempting to close off the ends of the rotor and stop recirculation was not satisfactory, in that the coarse rejects particles simply rotate with the rotor foils and produce excessive wear of the screen.

A search in the facilities of the United States Patent and Trademark Office has located the following U.S. Pat. Nos. as the closest prior art:

1,134,304
2,621,793
4,238,324
4,287,055
4,316,768
4,697,982

This prior art describes a variety of screening devices for screening pulps but none addresses the plugging problem encountered with the horizontal hollow rotor screening device referred to above, nor do they suggest solutions to that problem.

SUMMARY OF INVENTION

In accordance with the present invention, the prior art plugging problem described above is overcome by modifying the structure of the rotor. In this regard, the internal wall of the rotor is structured so as to be outwardly tapered from the upstream end towards the downstream end and the hub supports which connect the rotor shell to the rotor hub and are located adjacent the downstream end of the rotor are elongate and are arranged at an angle to the axis of the rotor.

These modifications achieve a two-fold effect. The offset angle and vane-like shape of the hub supports creates pumping action within the rotor to pull material through the interior of the rotor, thereby assisting the rotor foil arrangement in creating recirculation. The sloping surface of the tapered or conical shape of the interior wall of the rotor causes heavy materials tending to accumulate at the wall under the centrifugal action of rotation of the rotor to slide towards the vanes, which then eject these heavy materials back into the feed chamber.

With this rotor arrangement, the screen filter has operated satisfactorily in the commercial facilities of the assignee without any noticeable build up of solids in the rotor interior and with only a minimal degree of screen wear.

Accordingly, in one aspect of the present invention, there is provided a rotary filter for separating an accepts fraction from a rejects fraction in an aqueous slurry of particulate material. The filter comprises housing means, inlet means to the housing for feeding the aqueous slurry thereto, outlet means from the housing for removing an accepts fraction therefrom, and screen means mounted in the housing in operative rotation to the outlet means and to permit the accepts fraction to pass therethrough and to prevent the rejects fraction from passing therethrough.

Rotor means is mounted within the housing adjacent the screen means for rotation about a generally horizontal axis. The rotor comprises a hollow cylindrical body, a hub and hub supports joining the hollow cylindrical body of the hub. The hollow cylindrical body has an internal surface which increases in diameter from a minimum diameter at one end to a maximum diameter. The hub and hub supports are located adjacent another end of the hollow cylindrical body with the hub supports being elongate in the axial direction of the rotor means and each being offset at an angle from the axis of the hollow cylindrical body.

DESCRIPTION OF PREFERRED EMBODIMENTS

Figure 1:
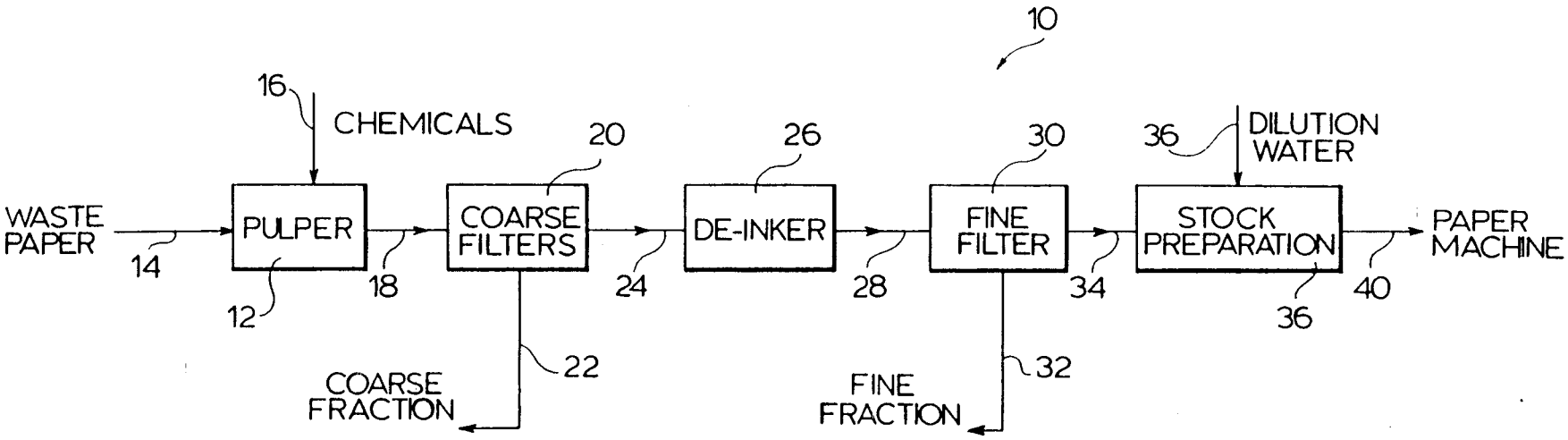
FIG. 1 is a schematic flow sheet of a typical newsprint processing and deinking plant for the recycle of newsprint.
Figure 2:
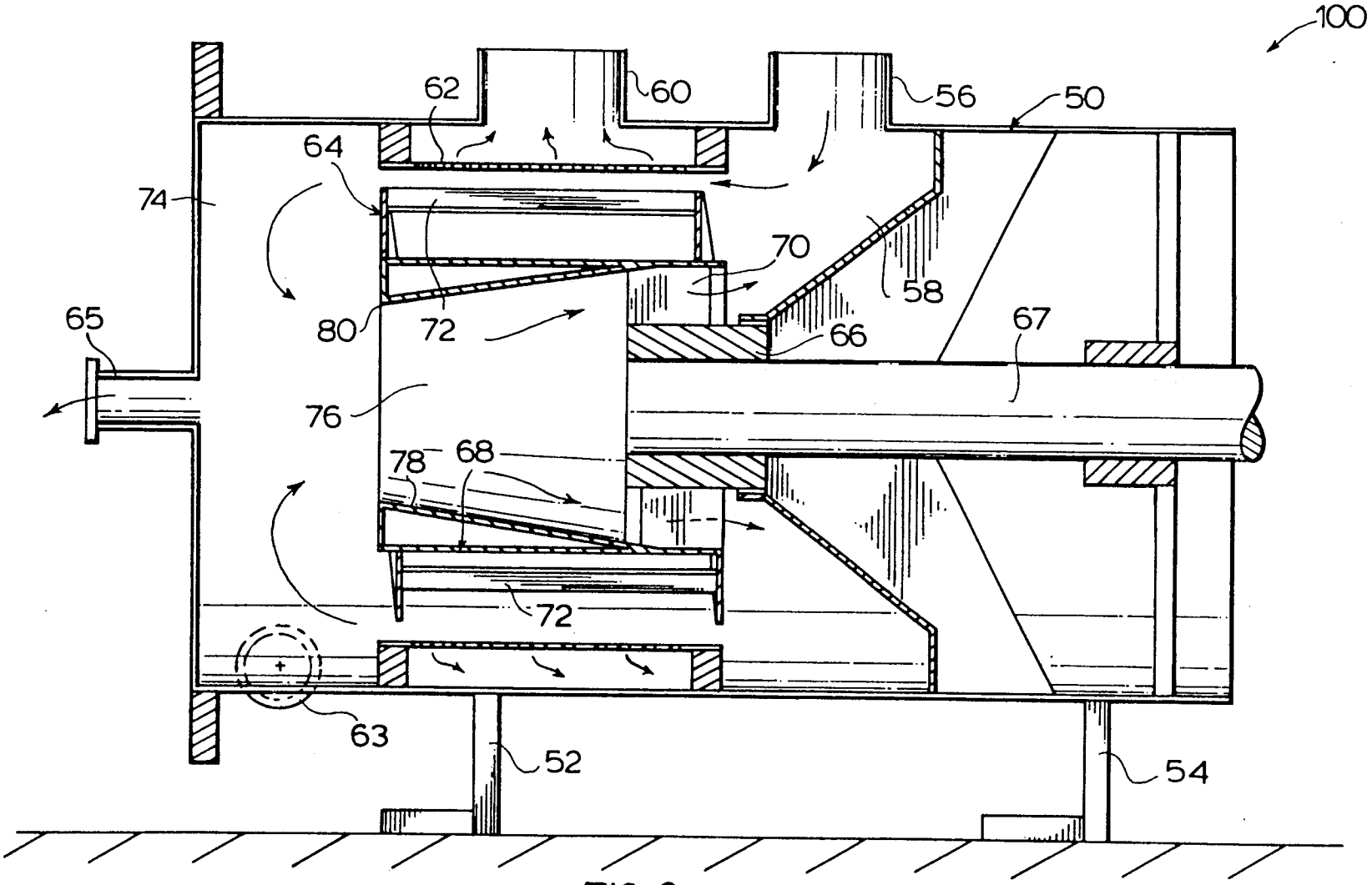
FIG. 2 is a longitudinal sectional view of a screening device provided in accordance with one embodiment of the invention.

Referring first to FIG. 1 of the drawings, a newsprint recycle plant 10 comprises a pulping station 12 to which the newsprint and other paper products are fed by line 14 and wherein the paper products are repulped with chemicals fed by line 16. The repulped material is fed by line 18 to a series of coarse filters 20 to remove a coarse fraction comprising heavy contaminants.

In the filtration operation 20, the pulp slurry is subjected to primary, secondary and tertiary screening in appropriate filters respectively to remove the heavy contaminants, with each screening providing an accepts fraction and a rejects fraction, with the accepts fraction being forwarded to a preceding screening except in the case of that for the primary screening and the rejects fraction being forwarded to a succeeding screening, except in the case of that produced in the tertiary screening.

The tertiary filter, therefore, has the heaviest load of the coarse and heavy particles and only a relatively minor proportion of the slurry comprises the desired paper pulp particles. It is this tertiary filter with which the present invention is concerned and which, prior to the invention, was the major screen plugging problem. Details of the construction of that filter are described below with respect to FIGS. 2 to 6.

The rejects fraction, containing the coarse and heavy contaminants separated from the slurry, is dumped from the tertiary filter by line 22. The accepts fraction, containing desired paper pulp particles, passes from the coarse filters 20 by line 24 to a deinking station 26 wherein ink is removed from the pulp in any desired manner.

Following deinking, the pulp slurry is forwarded by line 28 to fine filters 30 to remove small and heavy contaminants by line 32 to provide a pulp slurry in line 34 sufficiently purified for reuse in papermaking. The pulp slurry is forwarded to stock preparation at 36 with diluent water fed by line 38. The resultant slurry is forwarded by line 40 to a paper-making machine.

As mentioned above, the present invention is concerned specifically with the structure of the tertiary filter employed in the coarse filter 20. The tertiary filter is designed to run continuously, to carry a heavy load of contaminants and, prior to the present invention, was prone to plugging, requiring plant shutdown and filter clean-out. The structure of one embodiment of filter 22 is illustrated in FIGS. 2 to 6.

Referring now to FIGS. 2 to 6, a screening device comprises an enclosed housing 50 which is of generally cylindrical shape and which is mounted on suitable supports 52 and 54 with its axis horizontal.

The housing 50 has an inlet 56 for receipt of an aqueous slurry of solid particles into a feed chamber 58 within the housing 50 for the recovery of cellulosic pulp fibres therefrom as an accepts fraction.

The housing 50 also has an outlet 60 through which the accepts fraction is removed from the housing 50. A circular screen or basket 62 is mounted within the housing 50 to permit the accepts fraction to pass therethrough to the outlet 60. The screen basket 62 is dimensioned to permit the small particle accepts fraction to pass therethrough while preventing the coarse and heavy contaminants from passing through.

The accepts fraction generally contains not only the desired cellulosic fibres but also some small dimensioned contaminants. These are removed at a later processing stage, as described above with respect to FIG. 1.

The housing 50 has two further outlets 63 and 65 through which the rejects fraction is removed from time-to-time, the bulk of the rejects being removed through outlet pipe 63 while lighter rejects are removed through outlet pipe 65.

Figure 4:
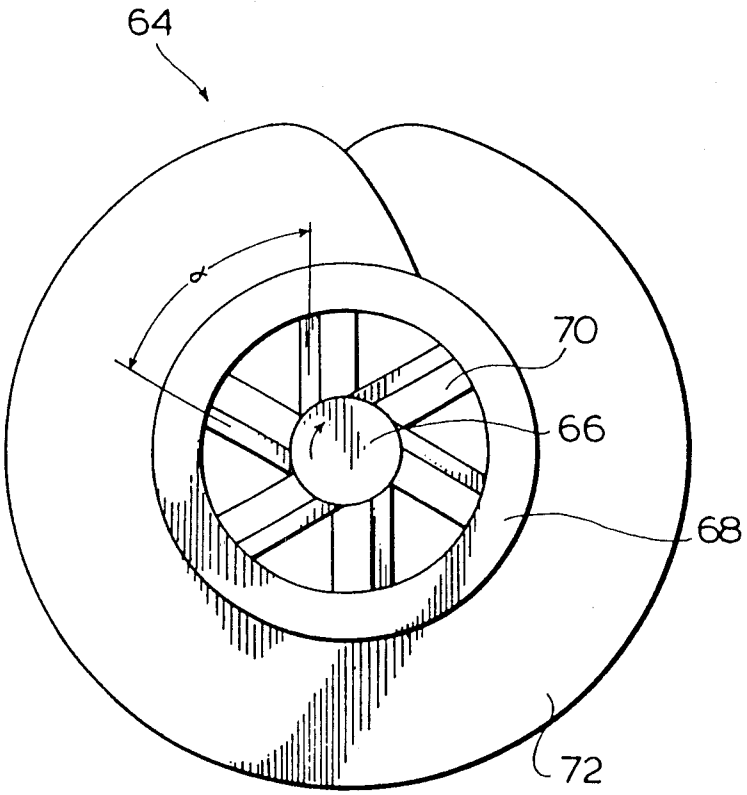
FIGS. 3 and 4 are perspective and end views respectively of the rotor used in the screening device of FIG. 2.
Figure 3:
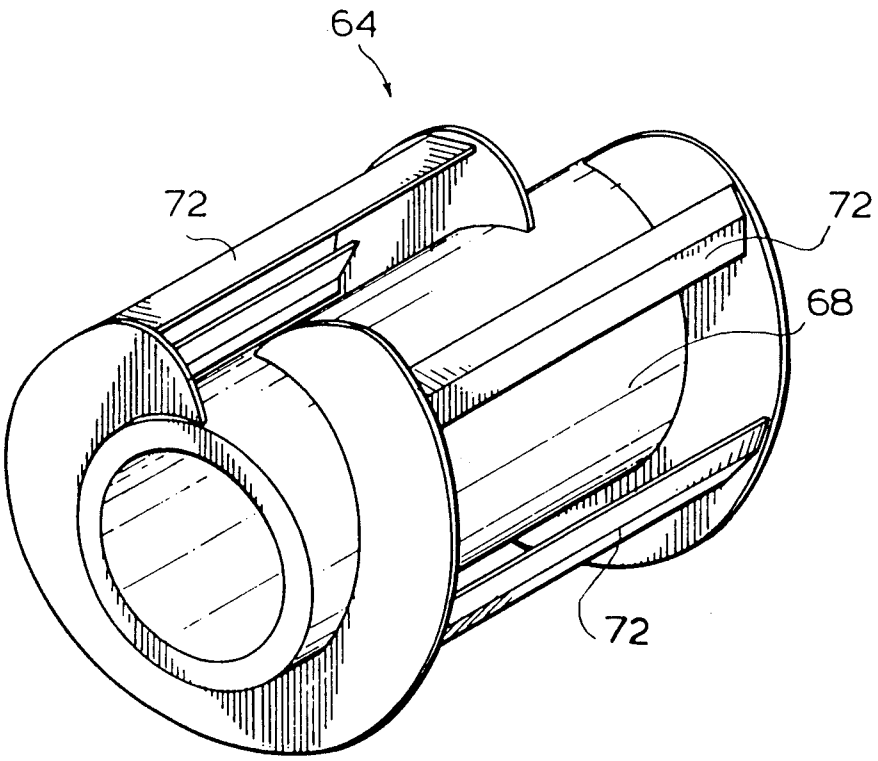
Figure 5:
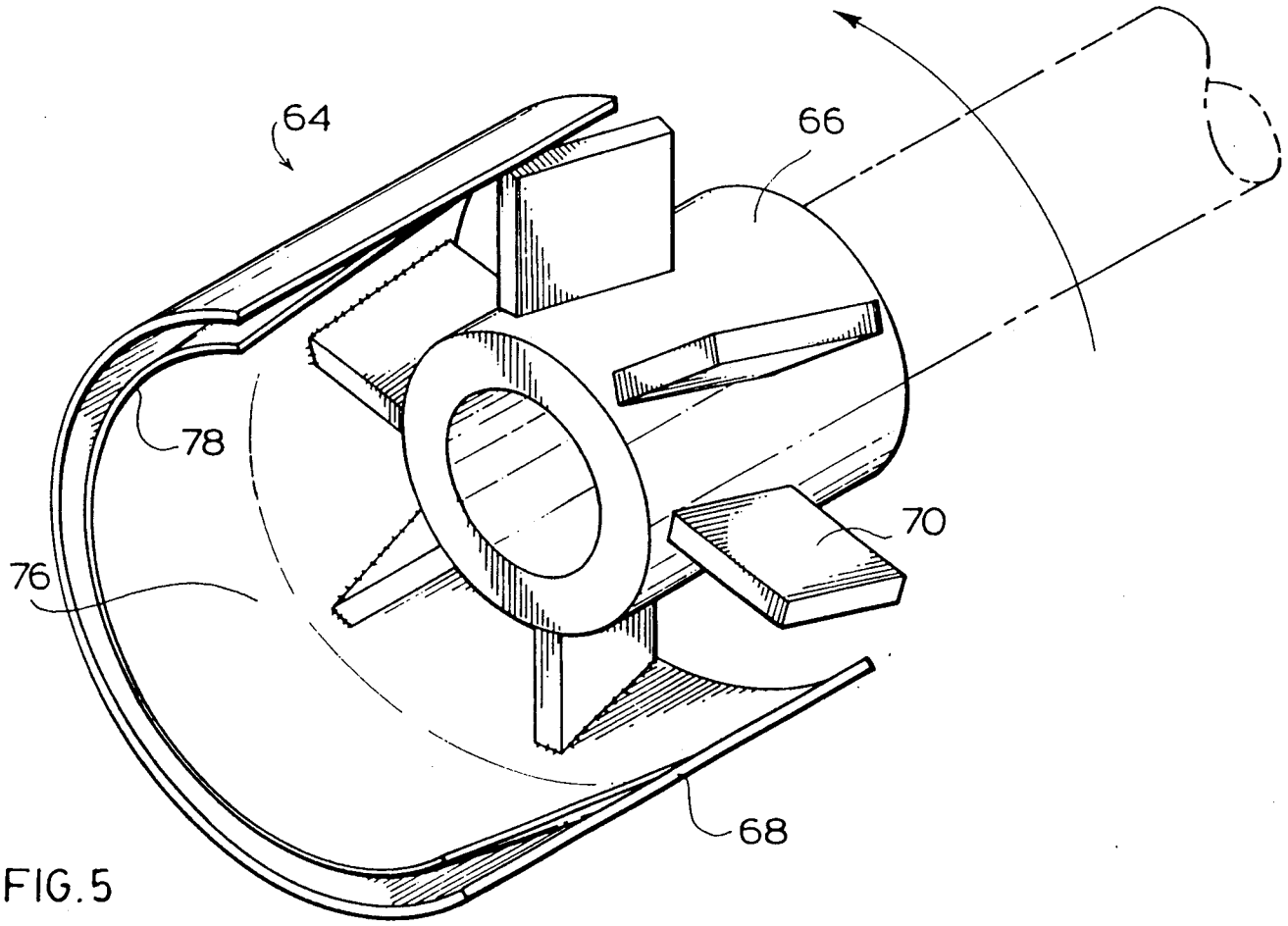
FIG. 5 is a close-up perspective view with parts cutaway for clarity, of the rotor used in the screening device of FIG. 2.

Mounted for rotation within the housing 50 is a rotor 64. The rotor 64 is of generally cylindrical shape and is positioned with its axis horizontal generally on the axis of the housing 50. The rotor 64 has a mounting hub 66 which is received on a drive shaft 67 extending to the exterior of the housing 50 and is operably connected to a drive rotor (not shown) in conventional manner. The rotor 64 is rotated in a clockwise manner as viewed from the rear end, as seen in FIG. 4.

The rotor 64 comprises a hollow cylindrical body 68 which is supported by the hub 66 by a plurality of vane-like elongate hub supports 70. The rotor 64 is positioned in the housing to be opposite to and in operative rotation to the screen basket 62. Provided on the external surface of the hollow cylindrical body 68 are a series of impellers or foils 72 (omitted in FIGS. 5 and 6 for clarity), which serve to induce circulation of the slurry from the feed chamber 58 past the stationary screen basket 62 to an anterior chamber 74, so that a slurry of the accepts fraction can pass through the screen basket 62. The rejects fraction accumulates in the anterior chamber 74 and is discharged therefrom from time to time through pipes 63 and 65.

The hollow cylindrical body 68 has a passageway 76 through which the slurry is recirculated to the feed chamber 58. Hence, the slurry is continuously received in the feed chamber 58 and is continuously recycled within the housing 50 first past the screen basket 62 for removal of a slurry of accepts particles to the anterior chamber 74 and back through the passageway 76 to the feed chamber 58.

This continuous recirculation is desirable having regard to the nature of the solids being processed and the relatively small quantity of particles of accepts size present therein. Not all such particles pass through the screen basket 62 at a single pass and continuous movement of the rejects heavy particles past the screen is desirable to avoid excessive abrasion.

In the conventional tertiary filter employed prior to the modification of the present invention, the hollow cylindrical body 68 had an inside diameter which was of the same dimension and the whole length of the passageway 76 and the hub supports 70 comprised four rectangular supports. As mentioned above, such unit was subject to plugging.

In accordance with the present invention, to avoid this plugging problem, two modifications have been made to the rotor 64. A first modification was to remove the rectangular hub supports and replace them by axially elongate vane-like hub supports 70. In the illustrated embodiment, there are six such hub supports, equally angularly displaced from one another at an angle of 60°. However, any desired number of such vanes 70, such as four, may be employed, commensurate with obtaining an adequate flow of slurry through the downstream and of the passageway 76, usually equally angularly offset from one another.

Figure 6:
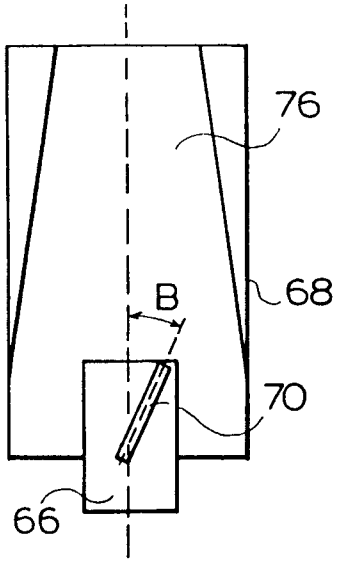
FIG. 6 is a plan view of the rotor used in the screening device of FIG. 2.

In addition to being axially elongate, the vanes 70 also are angularly offset by an angle B from the axis of the rotor 64 as most clearly seen in FIG. 6. This offset angle and the rotation of the rotor 64 create a pumping effect in the passageway 76 to assist the foils 72 in the recirculation of the slurry within the housing 50. The pumping action achieved by the vanes 70 may be sufficient to effect circulation of the slurry within the housing, permitting the impellers or foils 72 to be omitted and a continuous outer surface of the rotor body 68 to be employed.

The angle of offset of the axis of the vane 70 with respect to the axis of the rotor 64 may vary, depending on the exterior to which pumping is desired and generally may vary from about 10° to about 30°, and adequate results have been achieved with six such hub vanes 70 each offset at an angle of approximately 20°.

The other modification to the rotor 64 is to provide the inner wall 78 of the hollow cylindrical body 68 of a conical shape, whereby the diameter of the passageway 76 increases from a minimum at the upstream end 80 with respect to slurry flow through the passageway, in regular manner to a maximum diameter adjacent the hub supports 70. The effect of this tapering of the wall 78 is to prevent heavier particles from accumulating against the wall 78 under the centrifugal force tended to be applied thereto by rotation of the rotor as the slurry passes through the passageway. Instead, the slope of the wall in the direction of the flow of the slurry tends to urge the particles to slide downstream towards the hub vanes 70, for ejection back into the feed chamber 58.

Since making the two modifications approximately six months ago, the assignees testing filter 22 at its commercial newsprint recycling plant 10 at Thorold, Ontario, Canada has operated continuously with no sign of plugging on the interior of the rotor, or build up of heavy debris on the screen basket, with only a minimal wear of the screen basket.

Prior to such modifications, plugging of the rotor and consequently of the screen was a regular occurrence and an attempt to overcome the problem by shutting off the ends of the passageway through the rotor only lead to excessive wear of the screen basket. The tertiary screen filter 100, modified as described herein, is now considered to operate satisfactorily in contrast to the generally unsatisfactory operation prior to such modifications.

SUMMARY OF DISCLOSURE

In summary of this disclosure, the present invention provides a modification to a recirculating slurry filter which enables improved operation to be achieved. Modifications are possible within the scope of this invention.

What we claim is:

1. A rotary filter for separating an accepts fraction from a rejects fraction in an aqueous slurry of particulate material, comprising:

having means comprising a generally cylinder housing arranged with its longitudinal axis extending generally horizontally, inlet means to said housing for feeding said aqueous slurry thereto outlet means in a side wall of said housing for removing an accepts slurry fraction therefrom, screen means mounted in the side wall of said housing in operative relation to said outlet means and dimensioned to permit said accepts fraction to pass therethrough and to prevent said rejects fraction from passing therethrough, rotor means mounted within said housing for rotation about a generally horizontal axis coaxial with the longitudinal axis of said cylindrical housing means said rotor means having an external surface adjacent to but spaced inwardly from said screen means to cause said aqueous slurry to pass from said inlet means to said outlet means across the outer surface of said rotor means, said rotor means comprising a hollow cylindrical body having a bore extending longitudinally of said rotor means from a first longitudinal extremity of said rotor means to a second longitudinal extremity of said rotor means, a hub and hub supports joining said hollow cylindrical body to said hub, said bore of said hollow cylindrical body having an internal surface which continuously increases in diameter from a minimum diameter at said first longitudinal extremity of said rotor means to a maximum diameter adjacent said hub and said hub supports, said hub and said hub supports being located adjacent said second longitudinal extremity of said rotor means, said hub supports being elongate in the longitudinal axial direction of the housing means and being offset at an angle from said generally horizontal axis of rotation of said rotor means.

2. The filter of claim 1 wherein said housing has further outlet means for removal of a rejects slurry fraction therefrom.

3. The filter of claim 1 wherein said rotor means has outer foil means shaped to impart motion to move said aqueous slurry past said screen means.

4. The filter of claim 1 wherein said screen means comprise a filter basket extending in a band within said housing adjacent said rotor and having an axial length approximately that of said hollow cylindrical body of said rotor means and communicating on its filtrate side with an annular chamber with which said outlet means communicates for removing said accepts slurry from the housing means.

5. The filter of claim 4 wherein said hollow cylindrical body of said rotor means is located between a feed chamber within said housing which is in communication with said inlet means and said housing has an anterior chamber from which a rejects slurry fraction may be removed from time to time through further outlet means and from which said slurry may be recirculated through said hollow cylindrical body to said feed chamber.

6. The filter of claim 5 wherein said hub is mounted on an axially-extending axle projecting to the exterior of the housing means.

7. The filter of claim 6 wherein said rotor means has outer foil means shaped to impart motion to move said aqueous slurry from said feed chamber to said anterior chamber past said filter basket to cause solid particles of accepts size to pass through the filter basket.

8. The filter of claim 7 wherein said hub supports are six in number and are equally angularly offset one from another.

9. The filter of claim 1, 3, 2 or 8 wherein the axis of each of said hub supports is offset from the axis of said hollow cylindrical body at an angle of about 10° to about 30°.

* * * * *